United States Patent [19]

Arnold

[11] Patent Number: 4,726,744

[45] Date of Patent: Feb. 23, 1988

[54] TUBOCHARGER WITH VARIABLE VANE

[75] Inventor: Steven D. Arnold, Indianapolis, Ind.

[73] Assignee: Household Manufacturing, Inc., Prospect Heights, Ill.

[21] Appl. No.: 33,887

[22] Filed: Apr. 2, 1987

Related U.S. Application Data

[63] Continuation of Ser. No. 791,071, Oct. 24, 1985, abandoned.

[51] Int. Cl.[4] ..... F04B 17/00; F04B 35/00

[52] U.S. Cl. ..... 417/407; 415/164

[58] Field of Search ..... 417/405, 406, 407; 60/600, 602; 415/163, 164

[56] References Cited

U.S. PATENT DOCUMENTS

| | | | |
|---|---|---|---|
| 2,428,830 | 10/1947 | Birman . | |
| 2,860,827 | 11/1958 | Egli . | |
| 3,033,519 | 5/1962 | Radtke | 415/163 |
| 3,059,415 | 10/1962 | Birman . | |
| 3,173,241 | 3/1965 | Birman . | |
| 3,232,043 | 2/1966 | Birman . | |
| 3,495,921 | 2/1970 | Swearingen . | |
| 3,639,075 | 2/1972 | Erwin et al. . | |
| 3,945,762 | 3/1976 | Leicht | 417/407 |
| 3,972,644 | 8/1976 | Johnson . | |
| 4,179,247 | 12/1979 | Osborn . | |
| 4,300,869 | 11/1981 | Swearingen | 415/164 |
| 4,302,149 | 11/1981 | Smale . | |
| 4,355,953 | 10/1982 | Nelson . | |
| 4,490,622 | 12/1984 | Osborn . | |

OTHER PUBLICATIONS

"The Charging of Diesel Engines for Passenger Cars Using Turbochargers with Adjustable Turbine Guide Vanes," Society of Mechanical Engineers, N.Y., N.Y.

*Primary Examiner*—Louis J. Casaregola
*Assistant Examiner*—Timothy S. Thorpe
*Attorney, Agent, or Firm*—Huff & Hanson

[57] ABSTRACT

A turbocharger having a plurality of adjustable vanes for varying gas flow to the turbine impeller of the turbocharger so as to vary the output power of the turbine. In a preferred embodiment, the turbocharger comprises a turbine empeller and a compressor impeller mounted for rotation on a common shaft. The turbocharger also includes a inlet turbine housing defining a volute shaped toroid about the periphery of the turbine impeller and having a generally circular opening forming a mating surface. An outlet turbine housing is secured to the turbine inlet housing and projects into the opening of the turbine inlet housing so as to define at least one bore. The turbocharger includes at least one vane comprising an airfoil portion, and integral shaft portion projecting from the airfoil portion, and an actuating arm portion extending from the shaft portion and having an integral pin portion. The airfoil portion is located between the volute shaped toroid and the periphery of the turbine impeller and the shaft portion is rotatably mounted in the bore. An actuating ring having a slot engaging the pin portion is provided to rotate the vane shaft portion so as to vary the orientation of the airfoil portion.

18 Claims, 5 Drawing Figures

TUBOCHARGER WITH VARIABLE VANE

This application is a continuation, of application Ser. No. 791,071, filed Oct. 24, 1985 now abandoned.

BACKGROUND OF THE INVENTION

The present invention relates to turbochargers and, more particularly, to turbochargers having adjustable vanes which can vary the exhaust gas flow to the turbine portion of the turbocharger so as to vary the output power of the turbine portion.

Turbochargers are well known devices which utilize the energy of exhaust gases from an internal combustion engine to compress combustion air flowing to the combustion chambers of the engine. Briefly, a turbocharger comprises two impellers mounted on opposite ends of a common shaft, each impeller capable of rotating within its own cavity within the turbocharger housing. One impeller functions as a fluid motor, the exhaust gases from the engine causing rotation of the impeller. At the other end of the common shaft, the other impeller, commonly termed the pump or compressor impeller, functions to draw in ambient air and td compress the air to higher pressure which can be used, for example, to increase the flow of combustion air into the engine to thereby increase engine power.

Thus, in this use, the turbocharger functions as an air mass flow control for the engine. As a consequence, the turbocharger must be designed in terms of impeller volutes and impeller blade orientation to best match the requirements of the engine over its entire range of speeds. With a conventional turbocharger of a fixed geometry design, such a match will necessarily be a compromise of the best performance possible at various engine speeds and torques. For example, if the turbocharger is designed so as to provide to the optimum air flow at maximum engine speed, the flow will be less than optimum at lower engine operating speeds and vice versa.

Furthermore, after the engine and turbocharger are operated for a period of time, wear and dirt accumulation can change the operating characteristics of one or both of the engine and turbocharger and thus the compromise match between the two components may change even further to the detriment of engine performance. The problem of matching the turbocharger with the engine is also compounded by the fact that, in a large scale manufacturing operation, there may be differences from one engine to another and from one turbocharger to another due to manufacturing tolerances. In view of the more stringent requirements for fuel economy and emissions which are forthcoming for motor vehicles, it would be highly desirable to provide a turbocharger which could match the engine over a wide range of operating conditions.

It has been long recognized in the turbocharger art that if the power of the turbine portion could be varied by a suitable control, one could precisely control the airflow to the engine at any engine speed and torque. In addition, with such a control, the airflow to the engine could be modified during transient power changes thus reducing so-called "turbo lag" and reducing particulate emissions. Furthermore, a turbocharger with a variable power turbine portion could compensate for changes in the engine or the turbocharger itself caused by wear and the accumulation of dirt or other foreign matter.

Such turbochargers having a variable power turbine are shown in, for example, U.S. Pat. No. 2,428,830 to Birmann and in U.S. Pat. No. 3,945,762 to Leicht. Despite the potential advantages of such turbochargers in enabling the turbocharger air output to be controlled to some extent, they have not achieved a significant penetration in the commericial turbocharger market. This is due, at least in part, to the inability to precisely control the turbocharger output, and the mechanical difficulties encountered in providing a variable power turbocharger which will withstand prolonged use.

SUMMARY OF THE INVENTION

It is therefore a feature of the invention to provide a turbocharger having a variable power turbine portion which can be precisely controlled.

Another feature of the invention is to provide a variable power turbine for a turbocharger which utilizes integrally formed gas flow guide vanes.

Yet another feature of the invention is to provide a turbocharger having a variable power turbine portion which utilizes an actuator ring supported by rotatable vane shafts.

Briefly, in one aspect, the present invention comprehends a turbocharger comprising a turbine impeller and a compressor impeller mounted for rotation on a common shaft, a turbine inlet housing for the inflow of a gas to the turbine impeller, the housing defining an annular shaped toroid about the periphery of the turbine impeller, at least two vanes comprising an airfoil portion, a shaft portion having an axis and extending from the airfoil portion, and an actuating arm portion projecting from the shaft transverse to the axis of the shaft portion, the air foil portion of each the vanes being circumferentially spaced about the periphery of the turbine impeller with the airfoil portion being between the impeller and the volute shaped toroid, an actuator ring including a slot for each vane, each slot engaging one of the actuating arm portions of the vanes such that upon rotation of the ring, the vane shaft portions rotate, said actuator ring being supported by at least some of the vane shaft portions, and means for rotating said actuator ring.

In another aspect, the present invention comprehends a turbocharger comprising a turbine impeller and a compressor impeller mounted for rotation on a common shaft, a turbine inlet housing defining a volute shaped toroid about the periphery of turbine impeller for the inflow of gas, the housing having a generally circular opening forming a mating surface, a turbine outlet housing secured to the turbine inlet housing and projecting into the opening of the outlet housing so as to contact portions of the mating surface to define at least one bore, at least one vane comprising an airfoil portion and an integral shaft portion projecting from the airfoil portion, said airfoil portion being located between the volute shaped toroid and the periphery of the turbine impeller and said shaft portion being rotably mounted in said bore, and means for rotating said vane shaft portion to vary the orientation of the airfoil portion of the vanes.

Further objects, advantages and features of the present invention will become more fully apparent from a detailed consideration of the arrangement and construction of the constituent parts as set forth in the following description taken together with the accompanying drawing.

DETAILED DESCRIPTION OF THE PREFERRED EMBODIMENTS

Figure 1:
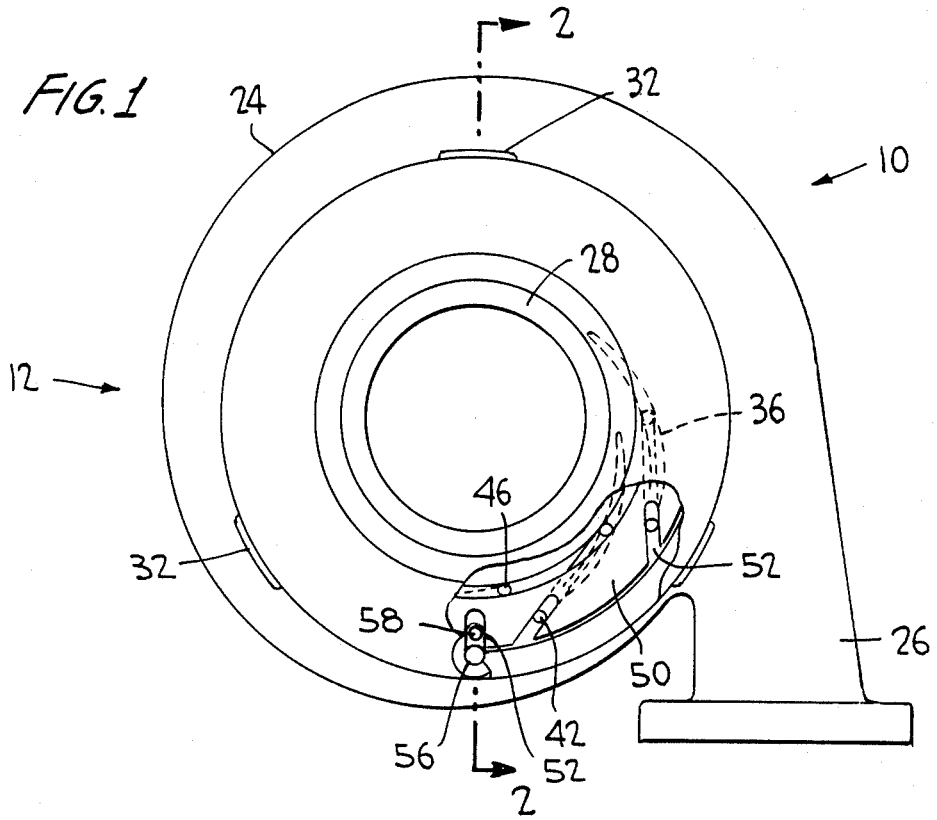
FIG. 1 is an elevational view of a variable power turbocharger according to the present invention, a portion of the turbocharger housing having been broken away and certain components being shown in section and phantom so as away to illustrate the variable vanes and the vane control structure.
Figure 2:
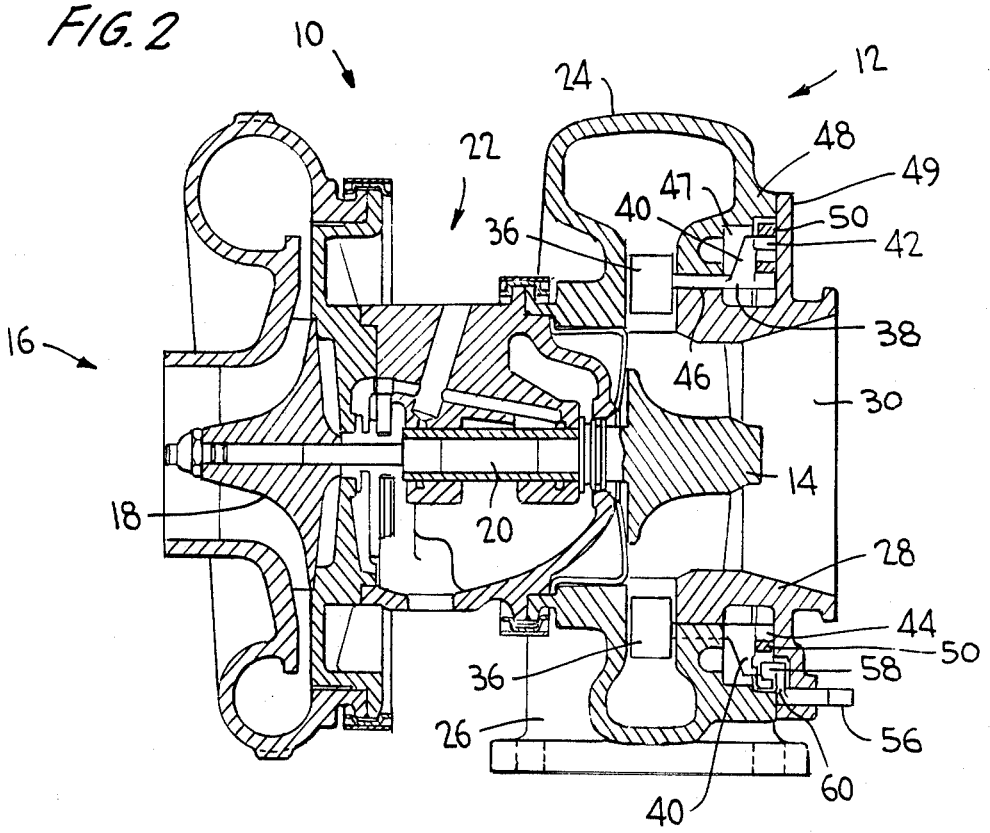
FIG. 2 is a cross-sectional view taken along line 2-2 of the turbocharger of FIG. 1.

Referring now to FIG. 1 and 2, shown is exhaust gas driven turbocharger 10 according to the present invention. Turbocharger 10 comprises turbine portion 12 including bladed turbine impeller 14 and compressor portion 16 including bladed compressor impeller 18, the two impellers being mounted on opposite ends of common shaft 20 extending through bearing assembly portion 22 such that the impellers rotate in unison. Since compressor portion 16 and bearing assembly portion 22 of turbocharger 10 are of conventional design and construction, these components will not be discussed hereinafter in any additional detail.

Turbine portion 16 comprises inlet housing 24 which encloses impeller 14 about its periphery with a volute shaped toroid having exhaust gas inlet 26. Extending into inlet turbine housing 24 is outlet turbine housing 28 forming gas outlet 30. Outlet housing 28 is secured to inlet housing 24 by any suitable means such as welds 32.

Figure 4:
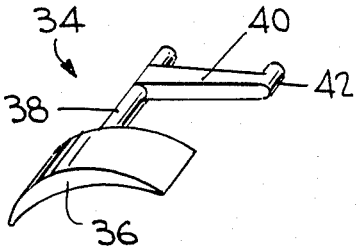
FIG. 4 is a perspective view of an adjustable vane used in the present invention.

In accordance with the present invention, turbine portion 12 includes a plurality of adjustable guide vanes 34. As is best shown in FIG. 4, each vane 34 comprises airfoil portion 36, shaft portion 38 extending laterally from the airfoil, arm portion 40 extending transverse to the axis of the shaft portion, and pin portion 42 whose axis extends parallel to that of the shaft portion. Preferably, arm 40 portion of vane 34 extends from shaft portion 38 at a distance spaced from the end of the shaft so that the end of the shaft portion forms a stub-like projection 44. Although airfoil portion 36 is shown as having a curved configuration, the portion may be provided with other configurations such as a planar configuration.

A significant feature of vane 34 is that it may be entirely integral which allows for precise control of airfoil orientation within the gas flow occuring in turbine portion 12 of turbocharger 10. This is due, at least in part, to the fact that the orientation of the airfoil portion 36 relative to the arm portion 40 can be made to precise tolerences. In addition, such integral vanes 34 are more suitable for the high temperature service encountered in turbine portion 12. Preferably, vanes 34 are made by conventional casting procedures such as investment casting but the vanes can also be made by other conventional procedures such as powder metallurgy and the like. Vanes 34 are composed of high temperature materials such as metals, ceramics and the like.

Vanes 34 are mounted in turbocharger 10 such that the vanes are spaced circumferentially about turbine impeller 14. The number of vanes 34 included in the turbocharger 10 may vary considerably but generally the inclusion of seven to fifteen provides satisfactory performance. As is best shown in FIG. 2, each vane 34 is mounted in turbine portion 12 such that airfoil portion 36 is between volute shaped toroid and turbine impeller 14. Shaft portion 38 of each vane 34 extends through bore 46 formed between the mating surfaces of inlet housing 24 and outlet housing 28. Arm portions 40 and pin portion 42 are contained in closed annular volume 47 defined by flange portions 48 and 49 of inlet housing 24 and outlet housing 28 respectively. Each bore 46 is of a sufficient dimension that shaft portion 38 of vane 34 can freely rotate therein so as to allow adjustment of the orientation of airfoil portion 36.

Figure 3:
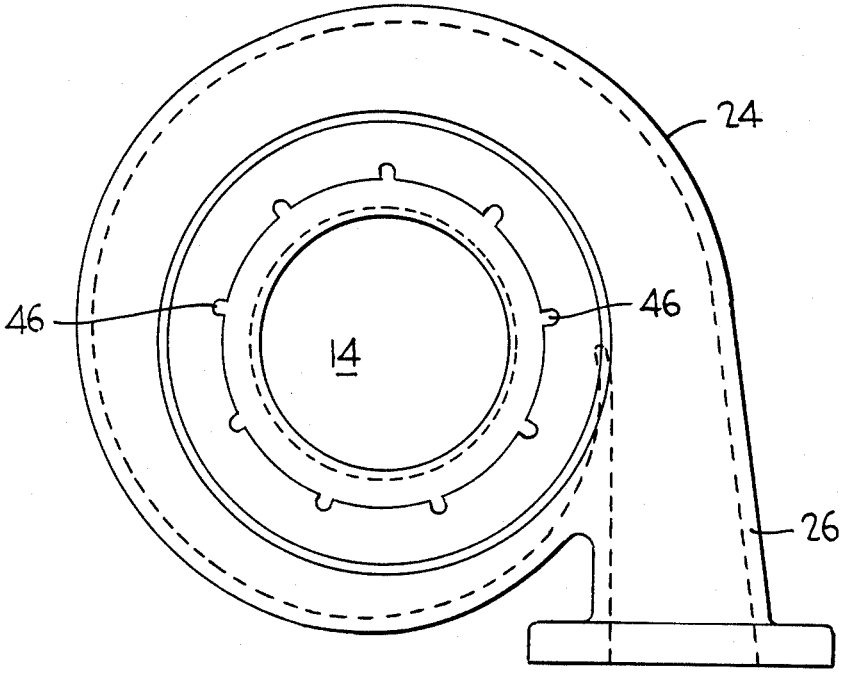
FIG. 3 is a detailed elevational view of the turbine inlet housing of the turbocharger of FIGS. 1 and 2.

Preferably, bores 46 for vane shaft portions 38 are U-shaped channels formed in the interior mating surface of the circular opening for turbine inlet housing 24 as is illustrated in FIG. 3. Thus, the mating surface of turbine outlet housing 28 would be generally cylindrical and the entire shaft portion 38 would be contained within the U-shaped channel. Alternatively, but less preferably, the mating surfaces of both the housing and outlet would be provided with corresponding semi-circular shaped channels such that when the two housings are assembled, the channels form a circular bores 46 therebetween. While this construction is advantageous since a circular bore 46 is formed, it may complicate the manufacture of turbine outlet housing 28 to some degree. It is also possible to form U-shaped channels in outlet housing 28 as opposed to inlet housing 24. Bores 46 that closely fit about vane shaft portions 38 are generally not necessary as closed annular volume 47 prevents loss of exhaust gas through the bores.

Figure 5:
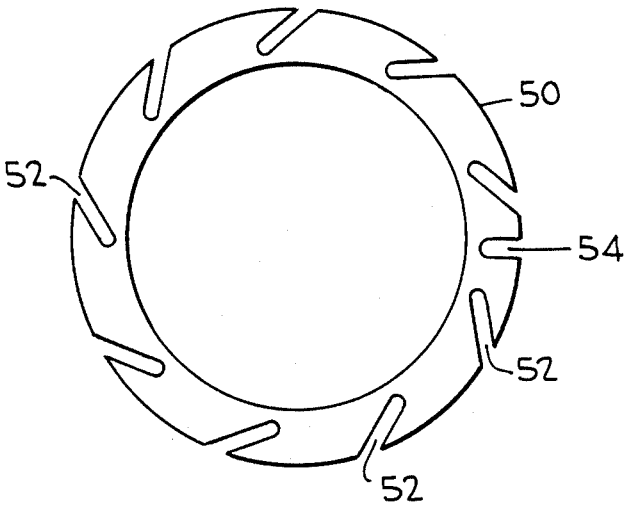
FIG. 5 is a plan view of an adjustor ring used in the turbocharger of the invention.

Referring particularly now to FIG. 5, control of vanes 34 is, in a preferred embodiment, accomplished by planar actuator ring 50 which contains a plurality of non-radial slots 52, one slot for pin portion 42 of each vane 34. Actuator ring also contains one radial slot 54.

As is best shown in FIG. 1, actuator ring 50 may be supported by projections 44 on shaft portions 38 of vanes 34, that is the projections engage the inner part of the actuator ring. Generally, it is not necessary that all the shaft portions 38 support actuator ring 50, for most turbochargers, support provided by three or four vane shaft portions is sufficient. Thus, non-supporting vane shaft portions 38 need not include stub like projection 44.

When actuator ring 50 causes vane shaft portions 38 to rotate, the vane shaft portions provide a rotating support for the ring which considerably reduces the energy required for ring rotation. In addition, this support provided by the vane shaft portions 38 maintains concentricity of the actuating ring 50 relative to the axis of turbine impeller 14.

As was previously mentioned, slots 52 of actuator ring 50 engage pin portion 42 on arm portion 40 of vanes 34. Thus as actuator ring 50 is rotated, vane shaft portions 38 are caused to rotate and thus the orientation of airfoil portions 36 are changed relative to turbine impeller 14. As the orientation of airfoils portions 36 change, the throat area of turbocharger as well as the flow angle into turbine impeller 14 are thereby changed. As a consequence, the power of the turbine portion 12 is altered and the output of the compressor impeller can be controlled.

A suitable means for causing actuator ring 50 to rotate comprises shaft 56 having camming element 58 on arm 60 which engages radial slot 54 in the actuator ring. Rotation of shaft 56 can be accomplished by any number of control mechanisms (not shown) such as a pneumatic actuator, an electric motor and the like which are controlled in response to engine and turbocharger operating conditions such as one or more of rotational speed and torque demand of the engine, exhaust gas and charging air temperatures and turbocharging pressure.

The use of shaft shaft 56 with eccentric camming element 58 is a preferred means for controlling the rotation of actuator ring 50 since as the element rotates 90°, the change in vane angle goes to zero thus allowing control of the range of turbine power that can be varied by controlling the eccentricity. In addition, stability and controllability are enhanced since the control is desensitized near the end of travel where vane angle has the most effect. Also, by changing the angular location of slot 54 relative the position of vanes 34, the active range where the power of turbine portion can be varied can be shifted up or down for different engine applications.

Another suitable means for rotating actuator ring 50 is, in a non-illustrated embodiment, to connect a link pin through a pivoting joint to the ring, the link pin extending through the inlet housing 24 appoximately tangentially to the actuator ring.

While there has been shown and described what is considered to be a preferred embodiments of the present invention, it will be obvious to those skilled in the art that various changes and modifications may be made therein without departing from the invention as defined in the appended claims.

It is claimed:

1. A turbocharger having a variable power turbine portion, the turbocharger comprising a turbine impeller and a compressor impeller mounted for rotation on a common shaft, a turbine inlet housing for inflow of a gas to the turbine impeller, the inlet housing defining a volute shaped toroid about the periphery of the turbine impeller, at least two vanes each comprising an airfoil portion, a shaft portion having an axis and extending from the airfoil portion, and an actuating arm portion projecting from the shaft transverse to the axis of the shaft portion, the vanes being circumferentially spaced about the periphery of the turbine impeller with the airfoil portion being between the turbine impeller and he volute shaped toroid, and annular actuator ring having an inner circular surface and including a slot for each vane, each slot engaging an actuating arm portion of one vane such that upon rotation of the ring, the vane shaft portions rotate, said actuator ring being rotatably supproted by at least some of the vane shaft portions engaging the inner circular surface of the actuator ring, and means for rotating said actuator ring.

2. A turbocharger in accordance with claim 1 which includes at least three vanes which rotatably support the actuator ring.

3. A turbocharger in accordance with claim 1 wherein said slots in the actuator ring are non-radial.

4. A turbocharger in accordance with claim 1 wherein the actuator ring further includes a radial slot and the means for rotating the actuator ring comprises a rotatable shat having a camming element on an arm which engages said radial slot.

5. A turbocharger in accordance with claim 1 including at least seven vanes, each having an airfoil portion spaced about the turbine impeller between the volute shaped toroid and the impellere and a shaft portion engaging a slot in the actuator ring, only some of the vanes rotatably supporting the ring.

6. A turbocharger in accordance with claim 1 further including a turbine outlet housing which engages the inlet turbine housing so as to form bores for rotational support of the shaft portions of the vanes.

7. A turbocharger in accordance with claim 6 wherein the bores are formed by U-shaped channels in the turbine inlet housing cooperating with the engaging portion of the turbine outlet housing.

8. A turbocharger in accordance with claim 6 wherein the bores are formed by adjacent semicircular channels in both the inlet turbine housing and the outlet turbine housing.

9. A turbocharger in accordance with claim 6 wherein all the portions of the vane are integral.

10. A turbocharger having a variable power turbine portion, the turbocharger comprising a turbine impeller having a periphery and a compressor impeller mounted for rotation on a common shaft, an inlet turbine housing defining a volute shaped toroid about the periphery of the turbine impeller for the inflow of gas, the inlet turbine housing having a generally circular opening forming a mating surface, a turbine outlet housing having a mating surface and being secured to the turbine inlet housing, at least one of the mating surfaces having a channel therein, the outlet turbine housing projecting into the opening of the turbine inlet housing projecting into the opeing of the turbine surfaces contact each other, the channel of one mating surface cooperating with the other mating surface so as to define at least one bore, at least one vane comprising an airfoil portion, an integral shaft portion projecting from the airfoil portion, and an integral actuating arm portion transverse to the axis of the shaft portion, said airfoil portion being located between the volute shaped toroid and the periphery of the turbine impeller and said shaft portion being rotatably mounted in said bore, and means for rotating said vane shaft portion to vary the orientation of the airfoil portion of the vane.

11. A turbocharger in accordance with claim 10 wherein the arm portion includes an integral pin portion extending on axis parallel to the axis of the shaft portion and the means for rotating said vane shaft portion comprises an actuator ring having a slot engaging the pin portion of the vane.

12. A turbocharger in accordance with claim 11 wherein the slot is non-radial.

13. A turbocharger in accordance with claim 11 wherein the means for rotating the vane shaft portion includes a rotatable shaft having a camming element on an arm which engages a radial slot in the actuator ring.

14. A turbocharger in accordance with claim 11 including a plurality of vanes rotatably supported in bores formed at the mating surfaces, at least some of the vanes rotatably supporting the actuator ring by engagement of the ring with the shaft portion of the vanes.

15. A turbocharger in accordance with claim 10 wherein the bore is formed by a U-shaped channel in the mating surface of the turbine inlet housing.

16. A turbocharger in accordance with claim 10 wherein the bore is formed by corresponding semi-circular channels in the inlet turbine housing and in the outlet turbine housing.

17. A turbocharger in accordance with claim 15 including a plurality of vanes rotatably supported in bores formed at the mating surface of the turbine inlet housing, at least some of the vanes rotably supporting the actuator ring by engagement with the shaft portion of the vanes.

18. A turbocharger in accordance with claim 17 wherein the means for rotating the vane shaft includes a rotatable shaft having a camming element on an arm which engages a radial slot in the actuator ring.

* * * * *